US011828198B2

(12) United States Patent
Bolgar et al.

(10) Patent No.: US 11,828,198 B2
(45) Date of Patent: Nov. 28, 2023

(54) VANE JOINT

(71) Applicant: ROLLS-ROYCE plc, London (GB)

(72) Inventors: Crispin Bolgar, Nottingham (GB); Steven Radomski, Nottingham (GB)

(73) Assignee: ROLLS-ROYCE plc, London (GB)

( * ) Notice: Subject to any disclaimer, the term of this patent is extended or adjusted under 35 U.S.C. 154(b) by 0 days.

(21) Appl. No.: 17/748,379

(22) Filed: May 19, 2022

(65) Prior Publication Data

US 2022/0403749 A1 Dec. 22, 2022

(30) Foreign Application Priority Data

Jun. 18, 2021 (GB) ..... 2108717

(51) Int. Cl.
*F01D 9/04* (2006.01)

(52) U.S. Cl.
CPC ..... *F01D 9/042* (2013.01); *F05D 2220/32* (2013.01); *F05D 2230/60* (2013.01); *F05D 2240/12* (2013.01)

(58) Field of Classification Search
CPC ..... F01D 9/00; F01D 9/02; F01D 9/04; F01D 9/041; F01D 9/042; F01D 25/243; F05D 2230/60; F05D 2240/12; F05D 2260/30; F05D 2260/31; F05D 2220/32
See application file for complete search history.

(56) References Cited

U.S. PATENT DOCUMENTS 4,832,568 A * 5/1989 Roth ..... F01D 9/042 415/189
2003/0185673 A1* 10/2003 Matsumoto ..... F01D 5/282 415/159
2009/0031732 A1* 2/2009 Wilson, Jr. ..... F01D 5/026 464/183
2009/0191053 A1* 7/2009 Bridge ..... F01D 5/225 415/208.2
2010/0129211 A1* 5/2010 Hart ..... F01D 25/246 29/889.22
2010/0266392 A1* 10/2010 Parkos, Jr. ..... C23C 4/10 427/454
2017/0241283 A1* 8/2017 Edwards ..... F01D 9/041
(Continued)

FOREIGN PATENT DOCUMENTS

EP 2 093 383 A1 8/2009
GB 2115883 A 9/1983
(Continued)

OTHER PUBLICATIONS

Nov. 30, 2021 Office Action and Search Report issued in British Patent Application No. GB2108717.6.
(Continued)

*Primary Examiner* — Elton K Wong
(74) *Attorney, Agent, or Firm* — Oliff PLC

(57) ABSTRACT

A vane for a gas turbine engine, the vane including a platform with an airfoil extending radially from the upper surface of the platform. The platform includes a joint portion which includes a circumferentially extending flange and a recessed surface both formed on either the upper or lower surface of the platform. The flange and the recessed surface extend from opposing circumferential edges of the joint portion and each include a substantially radially-extending through hole.

12 Claims, 4 Drawing Sheets

(56) References Cited

U.S. PATENT DOCUMENTS

| | | | | |
|---|---|---|---|---|
| 2020/0024989 | A1* | 1/2020 | Lamson | F01D 5/225 |
| 2020/0149418 | A1* | 5/2020 | Whittle | F01D 5/284 |

FOREIGN PATENT DOCUMENTS

| | | | |
|---|---|---|---|
| GB | 2 551 164 | A | 12/2017 |
| WO | 2014/062270 | A2 | 4/2014 |
| WO | 2018/009264 | A1 | 1/2018 |
| WO | 2020/263394 | A1 | 12/2020 |

OTHER PUBLICATIONS

Oct. 31, 2022 Extended Search Report issued in European Patent Application No. 22174038.4.

* cited by examiner

VANE JOINT

FIELD OF THE DISCLOSURE

The present disclosure relates to a vane or stator e.g. to an outlet guide vane. In particular, the present disclosure relates to a joint arrangement between circumferentially adjacent vanes or stators.

BACKGROUND

Fan outlet guide vanes (OGVs) within turbofan engines are multifunctional components, which de-swirl the airflow, provide noise suppression, and act as one of the main engine structures. At their platform (base), OGVs are typically joined to the front structure or engine support structure of a gas turbine engine by flanges, such that they are circumferentially adjacent to each other.

When the engine is in operation, each OGV is subjected to torque loading.

The recent introduction of gear boxes into some gas turbine engine engines has resulted in the removal of some of the supporting structures which traditionally react the torque loads. Furthermore, the high bypass ratio present in some gas turbine engines reduces the design space available to create a supporting structure for these high loads. This can result in the joints between OGVs and the supporting structure being more susceptible to rolling.

Accordingly, the present disclosure provides a vane or stator (e.g. an outlet guide vane) having a structure designed to allow for an improved joint configuration with a supporting structure.

SUMMARY

According to a first aspect there is provided a vane/stator for a gas turbine engine, the vane comprising a platform having an upper surface and a lower surface, the platform comprising a mounting portion on which an airfoil is mounted extending radially from the upper surface, and a joint portion at a first axial end, one of the upper or lower surfaces of the joint portion comprising a circumferentially-extending flange and a recessed surface, wherein the flange and recessed surface extend from opposing circumferential edges of the platform and each comprise a substantially radially-extending through hole.

By providing a circumferentially-extending flange and a circumferentially-extending recessed surface from opposing circumferential edges, the flange can be positioned against the recessed surface of a circumferentially adjacent joint portion with the through holes aligned (i.e. the through holes are axially and circumferentially aligned with the axes of the through holes aligned e.g. in a substantially radial direction) and a single fixing element e.g. a single bolt can be used to secure the adjacent platforms to each other and to a front structure of the gas turbine engine. The single fixing element will be subjected to opposing torque loads from each adjacent platform, the opposing loads at least partially cancelling each other so that the platforms (and fixing elements) can withstand greater roll.

In some embodiments, the upper (i.e. radially outer) surface of the joint portion comprises the circumferentially-extending flange and the recessed surface. Accordingly, in these embodiments, the flange can overlie the recessed surface of a circumferentially adjacent joint portion with the axes of the through holes aligned (i.e. the axis are collinear).

In these embodiments, the flange may have a lower surface which, in use, may abut the recessed surface. To facilitate this abutment, the lower surface of the flange may be substantially aligned with the recessed surface in the circumferential direction.

In other embodiments, where the lower (i.e. radially inner) surface of the joint portion comprises the flange and recessed surface, the flange may have an upper surface which, in use, may abut the recessed surface. To facilitate this abutment, the upper surface of the flange may be substantially aligned with the recessed surface in the circumferential direction.

The recessed surface may extend from the first axial end face of the platform (as well as from the circumferential edge of the platform). In some embodiments, the joint portion may be provided at an axially upstream (towards the fan) end of the platform. In these embodiments, the recessed surface may extend from the axially upstream end face (as well as from the circumferential edge of the platform).

In some embodiments, the flange has a convex curved circumferential end face.

The recessed surface may be defined by a first radially-extending wall extending substantially radially inwards from the upper surface towards the recessed surface. The first wall may join the circumferential edge of the platform to the axial end face. The first wall may have a concave curved profile perpendicular to the plane of the recessed surface. The concave curved profile may be complementary to the convex profile of the flange circumferential end face.

In some embodiments, the platform has a second radially-extending wall extending substantially radially away from the flange. In these embodiments, where the flange is provided on the upper surface of the platform, the second radially-extending wall extends substantially radially inwards from the lower surface of the flange (to the lower surface of the platform). In other embodiments where the flange is provided on the lower surface of the platform, the second radially-extending wall extends substantially radially outwards from the upper surface of the flange (to the upper surface of the platform).

In some embodiments, the second wall has a concave curved profile perpendicular to the plane of the flange.

In some embodiments, the platform has a third radially-extending wall extending substantially radially away from the recessed surface. The third radially-extending wall partly defines the circumferential edge of the platform. In these embodiments, where the recessed surface is provided on the upper surface of the platform, the third radially-extending wall extends substantially radially inwards from the recessed surface to the lower surface of the platform. In other embodiments where the recessed surface is provided on the lower surface of the platform, the third wall extends substantially radially outwards from the recessed surface to the upper surface of the platform.

In some embodiments, the third wall has a convex curved profile perpendicular to the plane of the recessed surface.

In some embodiments, the concave curved profile of the second wall may be complementary to the convex curved profiled of the third wall.

In some embodiments, the flange may comprise a recess (on the upper or lower surface of the platform) circumscribing the through hole to allow the fixing element to be flush with the upper or lower surface of the platform. For example, the through hole may be a countersink or counterbored hole.

In some embodiments, the platform comprises axially opposing joint portions. In these embodiments, the pair of recessed surfaces or pair of flanges may be axially aligned or may be diagonally opposed on the platform.

In some embodiments, the upper surface of the joint portion is radially recessed from the upper surface of the mounting portion of the platform.

In some embodiments, the vane/stator is a guide vane e.g. an outlet guide vane such as a fan outlet guide vane.

In a second aspect, the present disclosure provides a vane/stator assembly comprising first vane and circumferentially-adjacent second vane, each as described for the first aspect, wherein the through hole in the flange on the first vane is aligned (i.e. is axially and circumferentially aligned) with the through hole in the recessed surface of the second vane, the assembly further comprising a fixing element extending substantially radially through the aligned through holes.

The circumferential edge of the platform of the first vane from which the flange depends is preferably in abutment with the circumferential edge of the platform of the second vane from which the recessed surface extends.

In some embodiments, the flanges/recessed surfaces are provided in the upper (i.e. radially outer) surfaces of the first and second vanes. Accordingly, in these embodiments, the flange of the first vane can overlie the recessed surface of the second vane with the axes of the through holes aligned.

In these embodiments, the flange of the first vane may have a lower surface which abuts the recessed surface of the second vane. To facilitate this abutment, the lower surface of the flange of the first vane may be substantially aligned in the circumferential direction with the recessed surface of the second vane.

In other embodiments, where the flanges/recessed surfaces are provided in the lower (i.e. radially inner) surface of first and second vanes, the flange of the first vane may have an upper surface which abuts the recessed surface of the second vane. To facilitate this abutment, the upper surface of the flange of the first vane may be substantially aligned in the circumferential direction with the recessed surface of the second vane.

In some embodiments, the flange of the first vane has a convex curved circumferential end face. The first radially-extending wall defining the recessed surface of the second vane may have a concave curved profile in the plane perpendicular to the recessed surface which may be complementary to the convex profile of the circumferential end face of the flange on the first vane. The first radially-extending wall defining the recessed surface of the second vane may abut the circumferential end face of the flange on the first vane.

In some embodiments, the platform of the first vane has a second radially-extending wall extending substantially radially away from the flange. In these embodiments, where the flange is provided on the upper surface of the platform of the first vane, the second radially-extending wall extends substantially radially inwards from the lower surface of the flange (to the lower surface of the platform) of the first vane. In other embodiments where the flange is provided on the lower surface of the platform of the first vane, the second radially-extending wall extends substantially radially outwards from the upper surface of the flange (to the upper surface of the platform) of the first vane.

In some embodiments, the second wall (of the first vane) has a concave curved profile perpendicular to the plane of the flange of the first vane.

In some embodiments, the platform of the second vane has a third radially-extending wall extending substantially radially away from the recessed surface. In these embodiments, where the recessed surface is provided on the upper surface of the platform of the second vane, the third radially-extending wall extends substantially radially inwards from the recessed surface to the lower surface of the platform of the second vane. In other embodiments where the recessed surface is provided on the lower surface of the platform of the second vane, the third wall extends substantially radially outwards from the recessed surface to the upper surface of the platform of the second vane.

In some embodiments, the third wall (of the second vane) has a convex curved profile perpendicular to the plane of the recessed surface of the second vane.

In some embodiments, the concave curved profile of the second wall of the first vane may be complementary to the convex curved profiled of the third wall of the second vane.

In some embodiments, the flange of the first vane may comprise a recess circumscribing the through hole and the fixing element (i.e. an upper surface of the fixing element) may be flush with the flange of the first vane. For example, the through hole may be a countersink or counter-bored hole.

In some embodiments, the joint portions of the first and second vanes may be provided at an axially upstream (towards the fan) end of the platforms.

In some embodiments, the first and second vanes may each comprise axially opposing joint portions.

In some embodiments, the platforms of the first and second vanes are substantially identical.

In some embodiments, the upper surfaces of the joint portions of both the first and second vanes are radially recessed from the upper surfaces of the platforms where the airfoils extend and the assembly comprises a circumferentially-extending panel which overlies the joint portions to be flush with the upper surfaces of the platforms where the airfoils extend.

In some embodiments, the vane/stator assembly further comprises a third vane as described for the first aspect, wherein the through hole in the recessed surface on the first vane is aligned with the through hole in the flange of the third vane, the assembly further comprising a second fixing element extending through the aligned through holes.

The circumferential edge of the platform of the third vane from which the flange depends is preferably in abutment with the circumferential edge of the platform of the first vane from which the recessed surface extends.

In embodiments where the flanges/recessed surfaces are provided in the upper surfaces of the first and second vanes, the flange/recessed surface is also provided in the upper surface of the third vane. Accordingly, in these embodiments, the flange of the third vane can overlie the recessed surface of the first vane with the radial axes of the through holes aligned.

In these embodiments, the flange of the third vane may have a lower surface which abuts the recessed surface of the first vane. To facilitate this abutment, the lower surface of the flange of the third vane may be substantially aligned in the circumferential direction with the recessed surface of the first vane.

In other embodiments, where the flanges/recessed surfaces are provided in the lower (i.e. radially inner) surface of first, second and third vanes, the flange of the third vane may have an upper surface which abuts the recessed surface of the first vane. To facilitate this abutment, the upper surface of the flange of the third vane may be substantially aligned in the circumferential direction with the recessed surface of the first vane.

In some embodiments, the flange of the third vane has a convex curved circumferential end face. The first radially-extending wall defining the recessed surface of the first vane may have a concave curved profile perpendicular to the plane of the recessed surface which may be complementary to the convex profile of the circumferential end face of the flange on the third vane. The first radially-extending wall of the first vane may abut the circumferential end face of the flange on the third vane.

In some embodiments, the platform of third vane has a second radially-extending wall extending substantially radially away from the flange. In these embodiments, where the flange is provided on the upper surface of the platform of the third vane, the second radially-extending wall extends substantially radially inwards from the lower surface of the flange (to the lower surface of the platform) of the third vane. In other embodiments where the flange is provided on the lower surface of the platform of the third vane, the second radially-extending wall extends substantially radially outwards from the upper surface of the flange (to the upper surface of the platform) of the third vane.

In some embodiments, the second wall (of the third vane) has a concave curved profile perpendicular to the plane of the flange of the third vane.

In some embodiments, the platform of the first vane has a third radially-extending wall extending substantially radially away from the recessed surface. In these embodiments, where the recessed surface is provided on the upper surface of the platform of the first vane, the third radially-extending wall extends substantially radially inwards from the recessed surface to the lower surface of the platform of the first vane. In other embodiments where the recessed surface is provided on the lower surface of the platform of the first vane, the third wall extends substantially radially outwards from the recessed surface to the upper surface of the platform of the first vane.

In some embodiments, the third wall (of the first vane) has a convex curved profile perpendicular to the plane of the recessed surface of the first vane.

In some embodiments, the concave curved profile of the second wall of the third vane may be complementary to the convex curved profiled of the third wall of the first vane.

In some embodiments, the flange of the third vane may comprise a recess circumscribing the through hole and the second fixing element (i.e. an upper surface of the second fixing element) may be flush with the flange of the third vane. For example, the through hole may be a countersink or counter-bored hole.

In some embodiments, the platforms of the first, second and third vanes are substantially identical.

In some embodiments, the upper surfaces of the joint portions of all of the first, second and third vanes are radially recessed from the upper surfaces of the mounting portions of the platforms and a circumferentially-extending panel overlies the joint portions of all three vanes to be flush with the upper surfaces of the mounting portions of the platforms.

In some embodiments, the vane assembly is an outlet guide vane assembly e.g. a fan outlet guide vane assembly.

In a third aspect, the present invention provides a gas turbine engine having a vane/stator assembly according to the second aspect.

As noted above, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence. Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds), for example in the range of from 0.28 to 0.32. These ratios may commonly be referred to as the hub-to-tip ratio. The radius at the hub and the radius at the tip may both be measured at the leading edge (or axially forward-most) part of the blade. The hub-to-tip ratio refers, of course, to the gas-washed portion of the fan blade, i.e. the portion radially outside any platform.

The radius of the fan may be measured between the engine centreline and the tip of a fan blade at its leading edge. The fan diameter (which may simply be twice the radius of the fan) may be greater than (or on the order of) any of: 220 cm, 230 cm, 240 cm, 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm, 390 cm (around 155 inches), 400 cm, 410 cm (around 160 inches) or 420 cm (around 165 inches). The fan diameter may be in an inclusive range bounded by any two of the values in the previous sentence (i.e. the values may form upper or lower bounds), for example in the range of from 240 cm to 280 cm or 330 cm to 380 cm.

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 220 cm to 300 cm (for example 240 cm to 280 cm or 250 cm to 270 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 330 cm to 380 cm may be in the range of from 1200 rpm to 2000 rpm, for example in the range of from 1300 rpm to 1800 rpm, for example in the range of from 1400 rpm to 1800 rpm.

In use of the gas turbine engine, the fan (with associated fan blades) rotates about a rotational axis. This rotation results in the tip of the fan blade moving with a velocity $U_{tip}$. The work done by the fan blades 13 on the flow results in an enthalpy rise dH of the flow. A fan tip loading may be defined as $dH/U_{tip}^2$, where dH is the enthalpy rise (for example the 1-D average enthalpy rise) across the fan and $U_{tip}$ is the (translational) velocity of the fan tip, for example at the leading edge of the tip (which may be defined as fan tip radius at leading edge multiplied by angular speed). The fan tip loading at cruise conditions may be greater than (or on the order of) any of: 0.28, 0.29, 0.30, 0.31, 0.32, 0.33, 0.34, 0.35, 0.36, 0.37, 0.38, 0.39 or 0.4 (all units in this paragraph being $Jkg^{-1}K^{-1}/(ms^{-1})^2$). The fan tip loading may be in an inclusive range bounded by any two of the values in the previous sentence (i.e. the values may form upper or lower bounds), for example in the range of from 0.28 to 0.31, or 0.29 to 0.3.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, 17, 17.5, 18, 18.5, 19, 19.5 or 20. The bypass ratio may be in an inclusive range bounded by any two of the values in the previous sentence (i.e. the values may form upper or lower bounds), for example in the range of form 12 to 16, 13 to 15, or 13 to 14. The bypass duct may be substantially annular. The bypass duct may be radially outside the engine core. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds), for example in the range of from 50 to 70.

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust may be in an inclusive range bounded by any two of the values in the previous sentence (i.e. the values may form upper or lower bounds), for example in the range of from 80 $Nkg^{-1}s$ to 100 $Nkg^{-1}s$, or 85 $Nkg^{-1}s$ to 95 $Nkg^{-1}s$. Such engines may be particularly efficient in comparison with conventional gas turbine engines.

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). Purely by way of example, a gas turbine as described and/or claimed herein may be capable of producing a maximum thrust in the range of from 330 kN to 420 kN, for example 350 kN to 400 kN. The thrust referred to above may be the maximum net thrust at standard atmospheric conditions at sea level plus 15 degrees C. (ambient pressure 101.3 kPa, temperature 30 degrees C.), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400K, 1450K, 1500K, 1550K, 1600K or 1650K. The TET at cruise may be in an inclusive range bounded by any two of the values in the previous sentence (i.e. the values may form upper or lower bounds). The maximum TET in use of the engine may be, for example, at least (or on the order of) any of the following: 1700K, 1750K, 1800K, 1850K, 1900K, 1950K or 2000K. The maximum TET may be in an inclusive range bounded by any two of the values in the previous sentence (i.e. the values may form upper or lower bounds), for example in the range of from 1800K to 1950K. The maximum TET may occur, for example, at a high thrust condition, for example at a maximum take-off (MTO) condition.

A fan blade and/or aerofoil portion of a fan blade described and/or claimed herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades may be formed integrally with a central portion. Such an arrangement may be referred to as a bladed disc or a bladed ring. Any suitable method may be used to manufacture such a bladed disc or bladed ring. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example 14, 16, 18, 20, 22, 24 or 26 fan blades.

As used herein, cruise conditions have the conventional meaning and would be readily understood by the skilled person. Thus, for a given gas turbine engine for an aircraft, the skilled person would immediately recognise cruise conditions to mean the operating point of the engine at mid-cruise of a given mission (which may be referred to in the industry as the "economic mission") of an aircraft to which the gas turbine engine is designed to be attached. In this regard, mid-cruise is the point in an aircraft flight cycle at which 50% of the total fuel that is burned between top of climb and start of descent has been burned (which may be approximated by the midpoint—in terms of time and/or distance—between top of climb and start of descent. Cruise conditions thus define an operating point of, the gas turbine engine that provides a thrust that would ensure steady state operation (i.e. maintaining a constant altitude and constant Mach Number) at mid-cruise of an aircraft to which it is designed to be attached, taking into account the number of engines provided to that aircraft. For example where an engine is designed to be attached to an aircraft that has two engines of the same type, at cruise conditions the engine provides half of the total thrust that would be required for steady state operation of that aircraft at mid-cruise.

In other words, for a given gas turbine engine for an aircraft, cruise conditions are defined as the operating point of the engine that provides a specified thrust (required to provide—in combination with any other engines on the aircraft—steady state operation of the aircraft to which it is designed to be attached at a given mid-cruise Mach Number) at the mid-cruise atmospheric conditions (defined by the International Standard Atmosphere according to ISO 2533 at the mid-cruise altitude). For any given gas turbine engine for an aircraft, the mid-cruise thrust, atmospheric conditions and Mach Number are known, and thus the operating point of the engine at cruise conditions is clearly defined.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be part of the cruise condition. For some aircraft, the cruise conditions may be outside these ranges, for example below Mach 0.7 or above Mach 0.9.

Purely by way of example, the cruise conditions may correspond to standard atmospheric conditions (according to the International Standard Atmosphere, ISA) at an altitude that is in the range of from 10000 m to 15000 m, for example in the range of from 10000 m to 12000 m, for example in the range of from 10400 m to 11600 m (around 38000 ft), for example in the range of from 10500 m to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to an operating point of the engine that provides a known required thrust level (for example a value in the range of from 30 kN to 35 kN) at a forward Mach number of 0.8 and standard atmospheric conditions (according to the International Standard Atmosphere) at an altitude of 38000 ft (11582 m). Purely by way of further example, the cruise conditions may correspond to an operating point of the engine that provides a known required thrust level (for example a value in the range of from 50 kN to 65 kN) at a forward Mach number of 0.85 and standard atmospheric conditions (according to the International Standard Atmosphere) at an altitude of 35000 ft (10668 m).

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

According to an aspect, there is provided an aircraft comprising a gas turbine engine as described and/or claimed herein. The aircraft according to this aspect is the aircraft for which the gas turbine engine has been designed to be attached. Accordingly, the cruise conditions according to this aspect correspond to the mid-cruise of the aircraft, as defined elsewhere herein.

According to an aspect, there is provided a method of operating a gas turbine engine as described and/or claimed herein. The operation may be at the cruise conditions as defined elsewhere herein (for example in terms of the thrust, atmospheric conditions and Mach Number).

According to an aspect, there is provided a method of operating an aircraft comprising a gas turbine engine as described and/or claimed herein. The operation according to this aspect may include (or may be) operation at the mid-cruise of the aircraft, as defined elsewhere herein.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

DETAILED DESCRIPTION

Aspects and embodiments of the present disclosure will now be discussed with reference to the accompanying figures. Further aspects and embodiments will be apparent to those skilled in the art.

Figure 1:
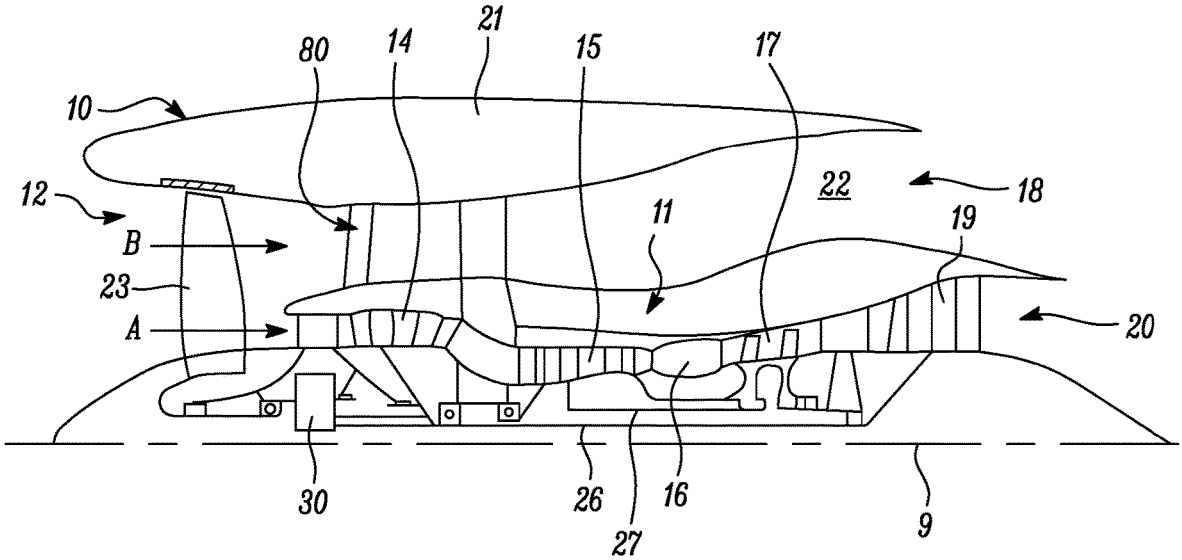
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the core exhaust nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
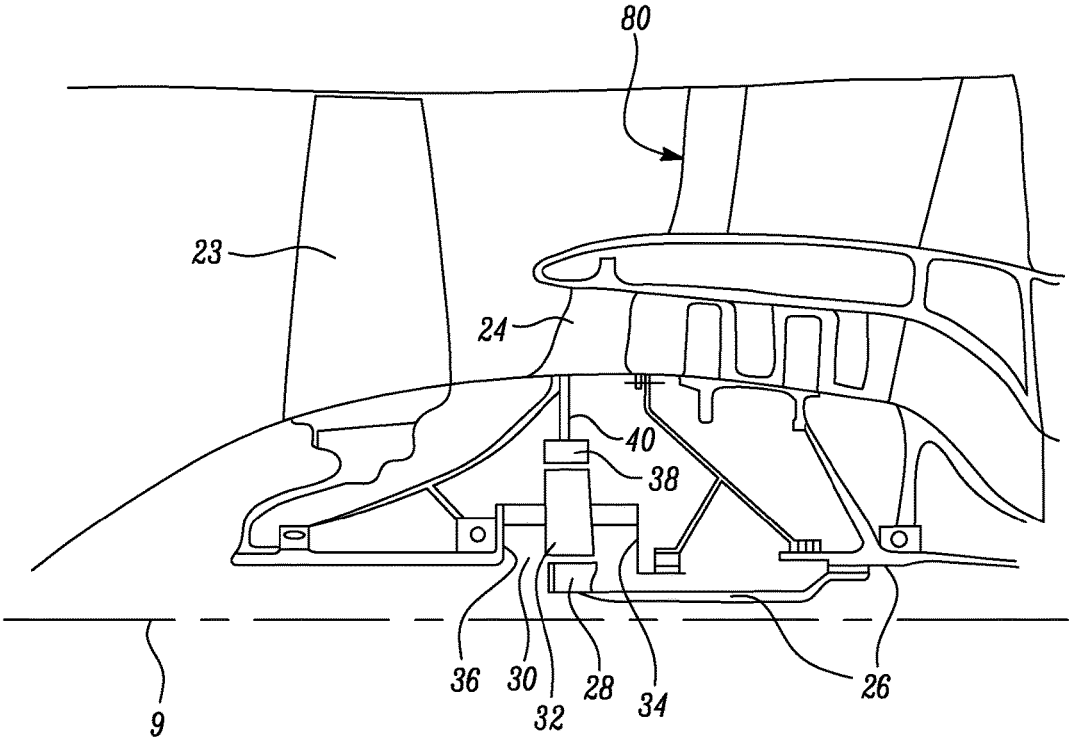
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
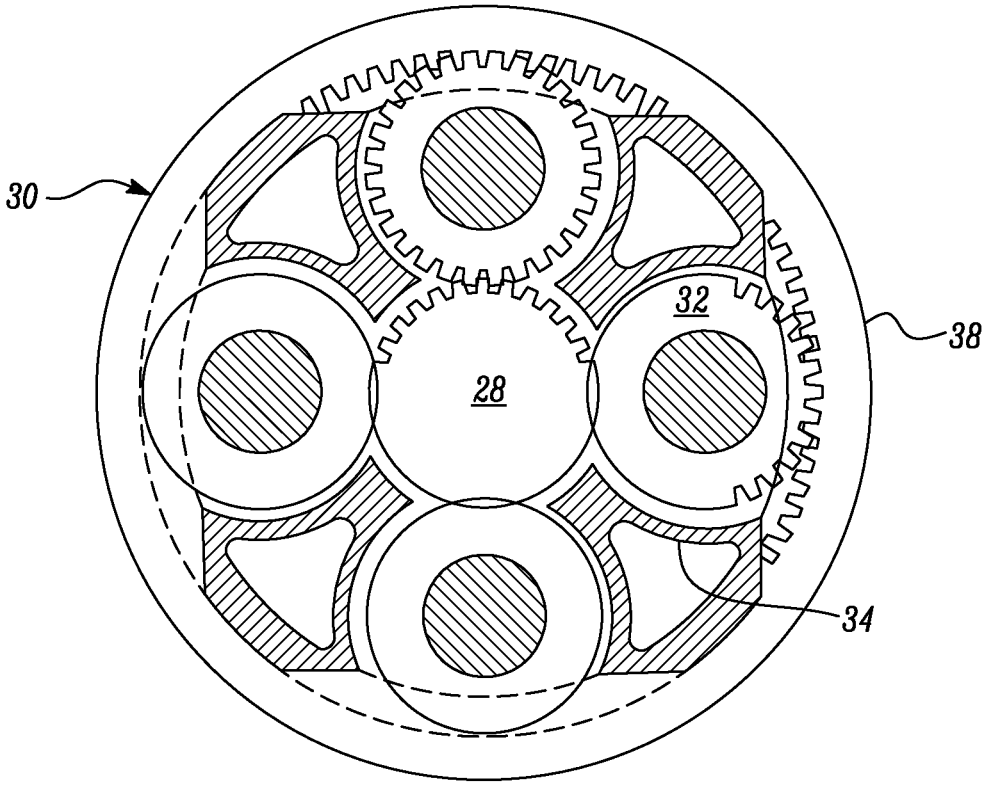
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the claimed invention. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core exhaust nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

FIG. 1 and FIG. 2 further show the location in the bypass duct 22 of an outlet guide vane (OGV) assembly 80 comprising a plurality of circumferentially-spaced outlet guide vanes 50.

Figure 4:
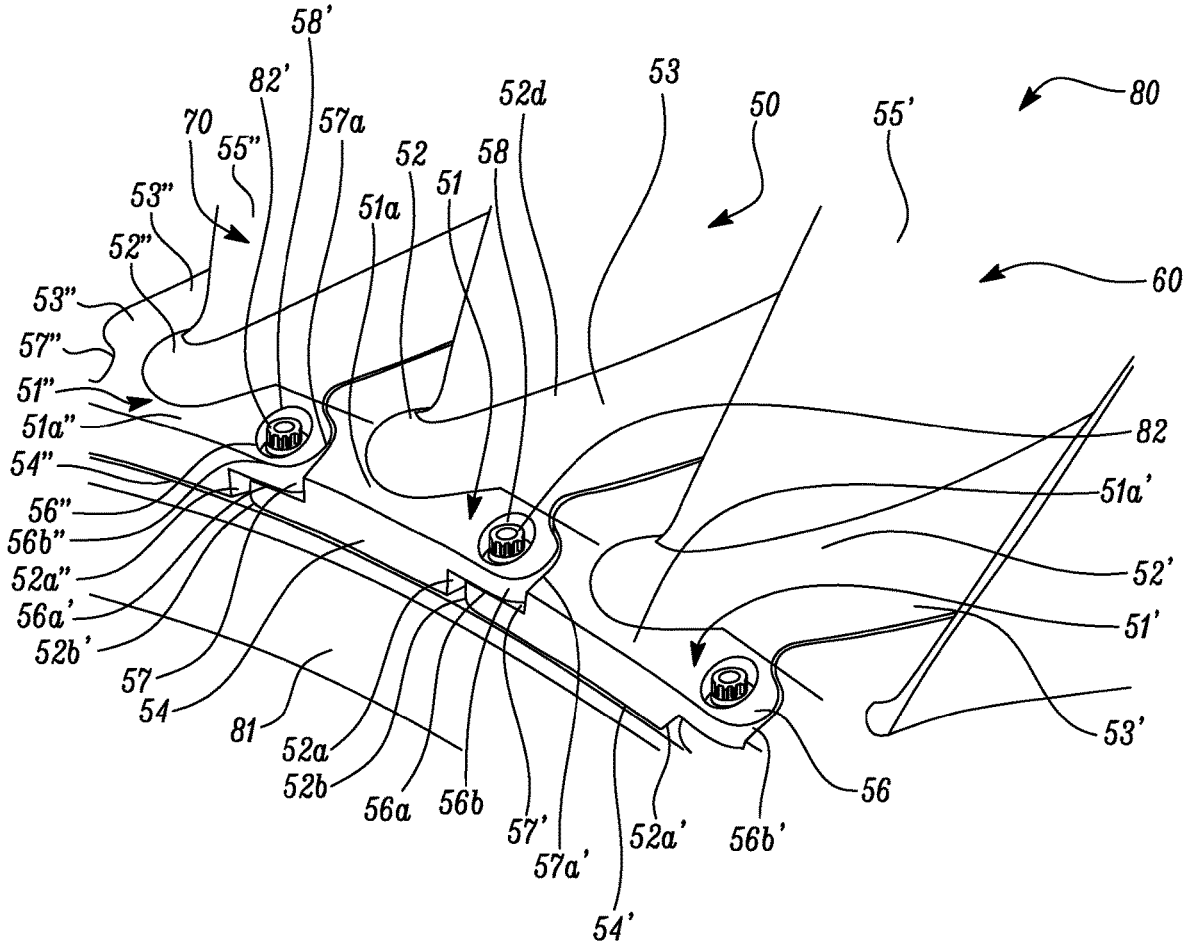
FIG. 4 shows a perspective view of an exemplary embodiment of an OGV assembly 80.

With reference to FIG. 4, there is an exemplary embodiment of a first OGV 50 for a gas turbine engine 10 which is circumferentially adjacent to a second OGV 60 and a third OGV 70. The first OGV 50 comprises a platform 52 having an upper surface 53 and a lower surface 54 with an airfoil 55 extending radially from the upper surface 53 of a mounting portion **52*d* of the platform 52. The upper surface 53 is the radially outer surface and the lower surface 54** is the radially inner surface (i.e. closest to the engine axis).

The platform 52 further comprises a joint portion 51 at its upstream axial end i.e. at the axial end closest to the fan.

The upper surface **51*a* of the joint portion 51 comprises a circumferentially-extending flange 56 and a recessed surface 57. The flange 56 and recessed surface 57 extend from opposing circumferential edges of the joint portion 51. The flange 56 comprises a lower surface 56*a* and a substantially radially-extending through hole 58 (extending from the upper surface 53 of the platform 52 to the lower surface 56*a* of the flange 56). The through hole 58** is a counter-bored through hole.

The recessed surface also comprises a through hole 59 (visible in FIG. 6 for identical OGV 60) extending from the recessed surface 57 to the lower surface 54 of the platform.

The second and third OGVs 60, 70 have platforms 52', 52" that are identical to the platform 52 of the first OGV 50. Accordingly, the second OGV 60 has a second joint portion 51' with an upper surface 53' from which a second flange 56' and a second recessed surface 57' extend and the third OGV 70 has a third joint portion 51" with an upper surface 53" from which a third flange 56" and a third recessed surface (not visible) extend.

In the assembly 80, the flange 56 of the first OGV 50 overlies the recessed surface 57' of the joint portion 51' of the second OGV 60 i.e. the lower surface of the flange **56*a* of the first OGV 50 abuts the recessed surface 57' of the second OGV 60. To facilitate this abutment, the lower surface 56*a* of the flange of the first OGV 50 is aligned in the circumferential direction with the recessed surface 57' of the second OGV 60**.

The through hole 58 of the flange 56 of the first OGV 50 is axially and circumferentially aligned with the axis of the through hole 59 (visible in FIG. 6) of the recessed surface 57' of the second OGV 60. A bolt 82 is affixed through the aligned through holes to secure the platform 52 of the first OGV 50 to the platform 52' of the second OGV 60 together with their circumferential edges abutting one another. The bolt 82 is flush with the upper surface of the flange 56.

The bolt 82 further extends into the front structure 81 of the gas turbine engine.

Likewise, the flange 56" of the third OGV 70 overlies the recessed surface 57 of the joint portion 51 of the first OGV 50 with the axis of the through hole 58' of the third OGV 70 aligned in the radial direction with the axis of the through hole (not visible) of the first OGV 50. A second bolt 82' passes through the aligned through holes (flush with the upper surface of the flange 56" of the third vane 70) to secure the platforms 51, 51" of the first and third OGV 50, 70 together as well as to the front structure 81 of the gas turbine engine 10. The circumferential edges of the first and third OGV 50, 70 are in abutment.

Although not shown, the OGV assembly 80 comprises further OGVs similar to the first, second third OGVs 50, 60, 70 so that the assembly 80 completely circumscribes the front structure 81.

Figure 5:
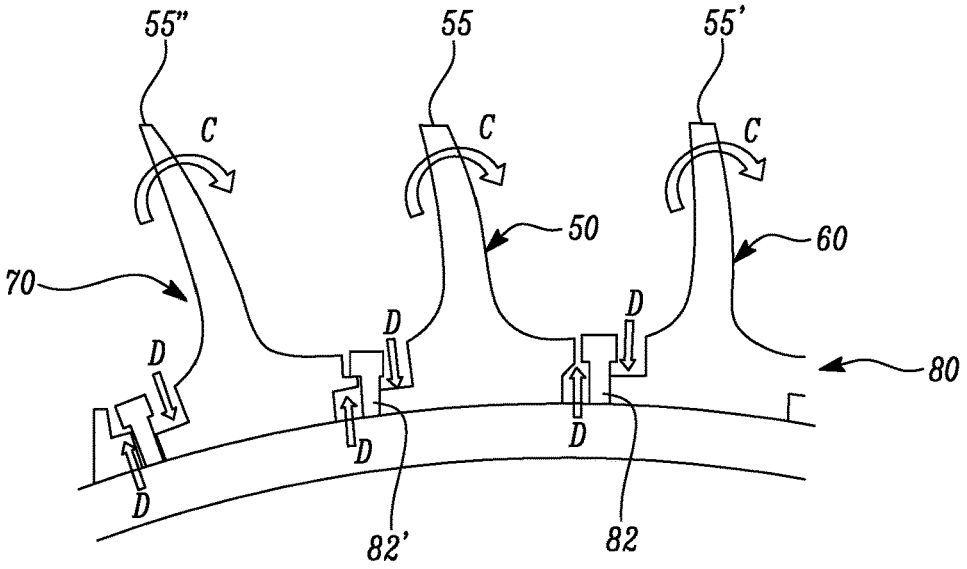
FIG. 5 is an axial view of an OGV assembly illustrating the balancing of forces in the fixing elements.

This arrangement ensures that the forces on the fixing bolts 82, 82' are reduced as substantially equal and opposite forces arising from adjacent airfoils 55, 55', 55" will be reacted at a single fixing bolt 82, 82' between adjacent OVGs, 50, 60, 70 as shown in FIG. 5. The tangential lean of the aerofoils 55, 55', 55" ensures that the direction of loading is maintained as load reversal would double the loads for the given joint configuration.

Each of the flanges 56, 56', 56" has a convex curved circumferential end face 56*b*, 56*b*'. 56*b*".

Figure 6:
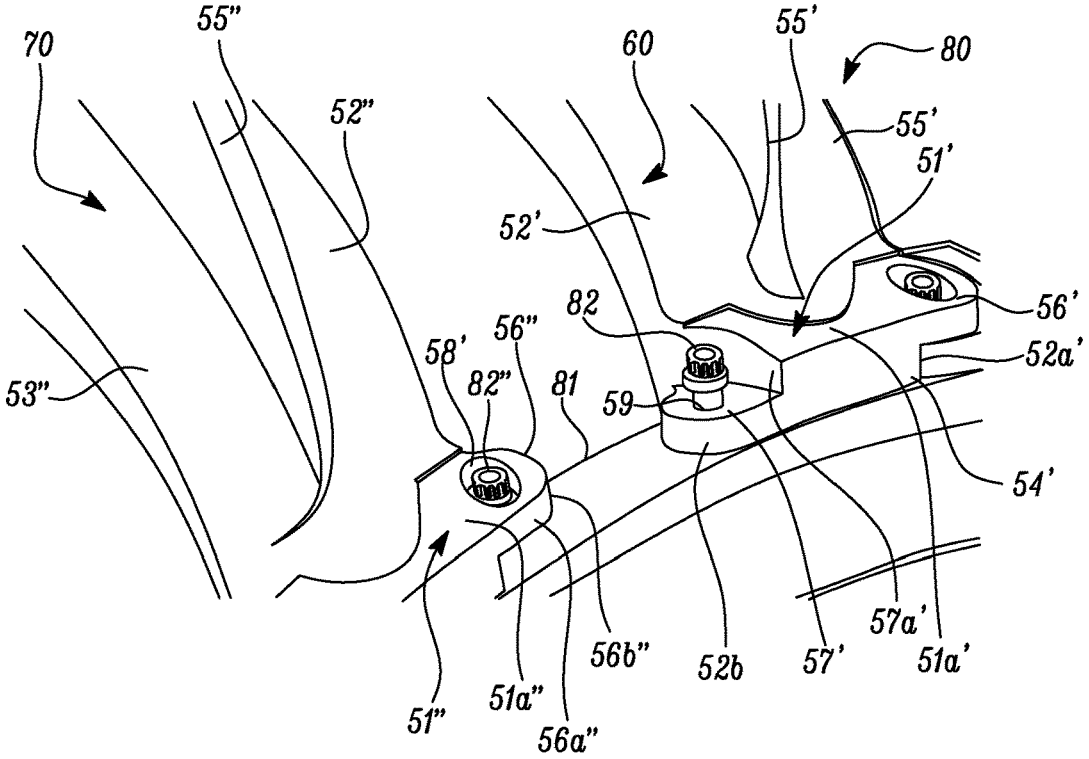
FIG. 6 shows an alternative view of FIG. 4 with the first OGV omitted.

Each of the recessed surfaces 57, 57', 57" (57" not visible) is defined by a respective first radially-extending wall 57*a*, 57*a*', 57*a*" which is most clearly seen in FIG. 6 (showing 57*a*') where the first OGV 50 has been omitted. Each first radially-extending end wall 57*a*, 57*a*', 57*a*" joins the circumferential edge of the respective platform 52, 52', 52" with the respective upstream axial end face of the platform 52, 52', 52". Each of the radially-extending walls 57*a*, 57*a*', 57*a*" has a concave curved profile in a plane perpendicular to the respective recessed surface 57, 57', 57" (57" not visible). This profile is complementary to the convex profile of the circumferential end face 56*b*, 56*b*', 56*b*" of the flange 56, 56', 56".

Accordingly, when the lower surface 56*a* of the flange 56 of the first OGV 50 overlies the recessed surface 57' of the second OGV 60, the curved circumferential end face 56*b* of the flange 56 of the first OGV 50 can abut against curved first radially-extending wall 57*a*' of the second OGV 60.

Each platform 52, 52', 52" has a respective second radially-extending wall 52*a*, 52*a*', 52*a*" extending radially inwards from the respective lower surface 56*a*, 56*a*', 56*a*" (56*a*" not visible) of the flange 56, 56', 56" to the lower surface 54, 54', 54" of the platform 52, 52', 52". The second radially-extending wall 52*a* has a concave curved profile perpendicular to the plane of the flange 56.

Each platform 52, 52', 52" also has a respective third radially-extending wall 52*b*, 52*b*', 52*b*" (52*b*" not visible) extending radially inwards from the respective recessed surface 57, 57', 57" (57" not visible) to the respective lower surface 54, 54', 54" of the platform 52, 52', 52". The third radially-extending wall 52*b*, 52*b*', 52*b*" (52*b*" not visible) has a convex curved profile perpendicular to the plane of the recessed surface 57, 57', 57" (57" not visible). This profile is complementary to the convex curved profile of the radially-extending first wall 57, 57', 57" (57" not visible).

Each upper surface 51*a*, 51*a*', 51*a*" of the joint portion 51, 51', 51" is radially recessed from the respective upper surface 53, 53', 53" of the platform 52, 52', 52". This is to allow a circumferentially-extending panel (not shown) to overlie the joint portions 51, 51', 51" and to be flush with the upper surfaces 53, 53', 53" of the platforms 52, 52', 52".

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A vane for a gas turbine engine, the vane comprising a platform having
- an upper surface and a lower surface,
- a mounting portion on which an airfoil is mounted, the airfoil extending radially from the upper surface, and
- a joint portion at a first axial end, wherein
- one of the upper surface or the lower surface comprises a circumferentially-extending flange and a recessed surface, and
- the flange and recessed surface extend from opposing circumferential edges of the joint portion and each comprise a substantially radially-extending through hole.

2. The vane according to claim 1 wherein the flange and recessed surface are on an upper surface of the joint portion.

3. The vane according to claim 2 wherein the flange comprises a lower surface which is substantially aligned with the recessed surface in the circumferential direction.

4. The vane according to claim 1 wherein the recessed surface extends from a first axial end face of the platform.

5. A vane/stator assembly comprising a first vane and a circumferentially-adjacent second vane, the first vane and the second vane being according to the vane of claim 1, wherein the through hole in the flange on the first vane is aligned with the through hole in the recessed surface of the second vane, the assembly further comprising a fixing element extending through the through hole in the flange on the first vane and the through hole in the recessed surface of the second vane.

6. The assembly according to claim 5 wherein the flange of the first vane overlies the recessed surface of the second vane with axes of the through hole in the flange on the first vane and the through hole in the recessed surface of the second vane aligned.

7. The assembly according to claim 6 wherein the flange of the first vane has a lower surface which abuts the recessed surface of the second vane, the lower surface of the flange of the first vane being substantially aligned in the circumferential direction with the recessed surface of the second vane.

8. The assembly according to claim 5 wherein the assembly is a fan outlet guide vane assembly.

9. A gas turbine engine having a vane/stator assembly according to claim 5.

10. The gas turbine engine according to claim 9 comprising:
- an engine core comprising a turbine, a compressor, and a core shaft connecting the turbine to the compressor;
- a fan located upstream of the engine core, the fan comprising a plurality of fan blades; and
- a gearbox that receives an input from the core shaft and outputs drive to the fan so as to drive the fan at a lower rotational speed than the core shaft.

11. The gas turbine engine according to claim 10, wherein:
- the turbine is a first turbine, the compressor is a first compressor, and the core shaft is a first core shaft;
- the engine core further comprises a second turbine, a second compressor, and a second core shaft connecting the second turbine to the second compressor; and
- the second turbine, second compressor, and second core shaft are arranged to rotate at a higher rotational speed than the first core shaft.

12. A vane/stator assembly comprising a first vane, a circumferentially-adjacent second vane, and a third vane, the first vane, the second vane and the third vane being according to the vane of claim 1, wherein
- the through hole in the flange on the first vane is aligned with the through hole in the recessed surface of the second vane, the assembly further comprising a fixing element extending through the through hole in the flange on the first vane and the through hole in the recessed surface of the second vane, and
- the through hole in the recessed surface on the first vane is aligned with the through hole in the flange of the third vane, the assembly further comprising a second fixing element extending through the through hole in the recessed surface on the first vane and the through hole in the flange of the third vane.

* * * * *